United States Patent [19]

Vernon

[11] Patent Number: 4,967,502

[45] **Date of Patent: * Nov. 6, 1990**

[54] FIREARM DISABLING APPARATUS

[76] Inventor: Terry M. Vernon, P.O. Box 17359, Fort Worth, Tex. 76102

[ * ] Notice: The portion of the term of this patent subsequent to Jul. 11, 2006 has been disclaimed.

[21] Appl. No.: 362,024

[22] Filed: Jun. 6, 1989

Related U.S. Application Data

[63] Continuation-in-part of Ser. No. 92,651, Sep. 3, 1987, Pat. No. 4,845,870.

[51] Int. Cl.[5] ..... F41A 17/74

[52] U.S. Cl. ..... 42/70.08; 42/66; 42/70.01

[58] Field of Search ..... 42/7, 66, 70.01, 70.08

[56] References Cited

U.S. PATENT DOCUMENTS

| | | | |
|---|---|---|---|
| 875,469 | 12/1907 | Tambour . | |
| 891,748 | 6/1908 | Tambour . | |
| 905,020 | 11/1908 | Tambour . | |
| 1,118,331 | 11/1914 | Carl . | |
| 1,569,856 | 1/1926 | Eriksen . | |
| 2,945,316 | 7/1960 | Mulno . | |
| 4,067,132 | 1/1978 | Smith . | |
| 4,135,320 | 1/1979 | Smith . | |
| 4,136,475 | 1/1979 | Centille . | |
| 4,154,014 | 5/1979 | Smith . | |
| 4,261,127 | 4/1981 | Karkkainen . | |
| 4,467,545 | 8/1984 | Shaw, Jr. . | |
| 4,570,370 | 2/1986 | Smith et al. . | |
| 4,593,487 | 6/1986 | Ruger et al. . | |
| 4,672,763 | 6/1987 | Cunningham . | |
| 4,682,435 | 7/1987 | Heltzel . | |
| 4,730,537 | 3/1988 | Matzagg et al. . | |
| 4,833,811 | 5/1989 | Wilkinson . | |
| 4,845,870 | 7/1989 | Vernon | 42/70.08 |

*Primary Examiner*—Stephen C. Bentley
*Assistant Examiner*—Richard W. Wendtland
*Attorney, Agent, or Firm*—Arthur F. Zobal

[57] ABSTRACT

The apparatus of the invention is adapted to be used in a firearm of the type having a body having an interior space, a hammer supported by the body for movement, and a trigger for actuating the hammer. A strut member is located in the interior space of the body and has one end pivotally connected to the hammer. A capsule is provided having first and second ends and a spring means located therein. Opening means is formed at the first end of said capsule whereby the spring means may be compressed by applying force to the spring means by way of said opening means. The capsule is adapted to be supported by the body in a given position relative to the second end of the strut member whereby the other end of the strut member will apply force to the spring means, by way of said opening means to allow sufficient spring compression to occur such that the hammer will fire the firearm when actuated by the trigger. Means is provided for releasably holding the capsule in the given position for firing purposes and for allowing the capsule to be released from the given position for releasing spring compression to disable the firearm.

In one embodiment, the capsule is completely removable from the firearm.

In another embodiment, a releasable keeper is provided which is movable into an opening for engaging the other end of the capsule for moving the capsule to the given position and for holding the capsule in the given position for firing purposes. The keeper may be released to allow the capsule to be moved away from the given position for disabling purposes.

21 Claims, 10 Drawing Sheets

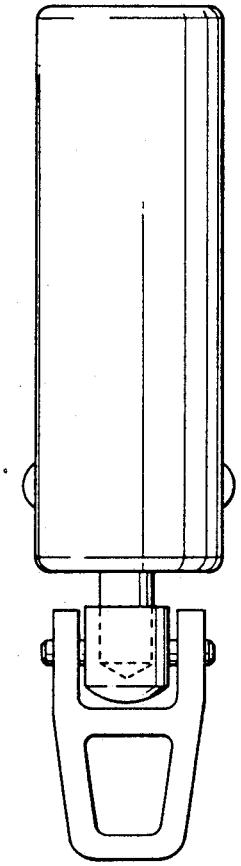
Fig. 16
Fig. 17
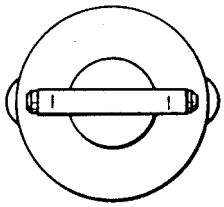
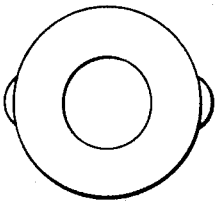
Fig. 19
Fig. 18
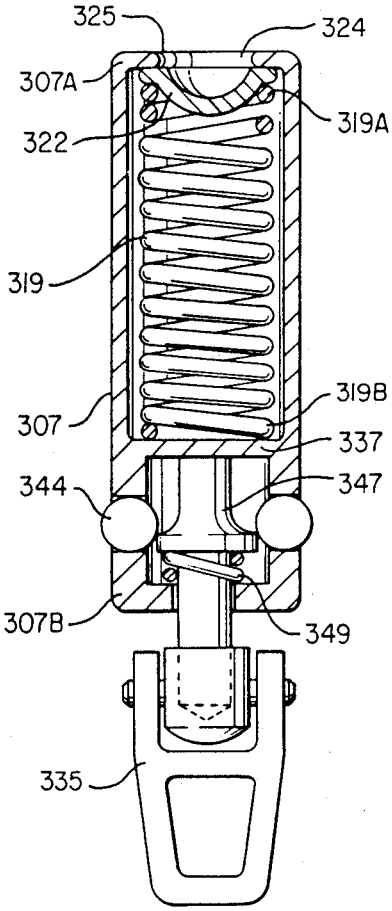

FIREARM DISABLING APPARATUS

This application is a continuation-in-part of U.S. Patent Application Serial No. 07/092,651, filed on Sept. 3, 1987 now U.S. Pat. No. 4,845,870.

BACKGROUND OF THE INVENTION

There is a well recognized need for the safest possible firing mechanisms for firearms of all types, whether handguns, rifles, shotguns, BB or pellet guns, etc. Previous attempts to solve the various problems involved seem to begin from the point of view that all firearms are to remain "armed" and in a state of functional readiness at all times, even when not in actual use. Safety features have been mostly viewed as "add-ons" which should not interfere with the firearm's primary purpose.

A need exists for a simple and inexpensive apparatus which will allow the user to maintain a firearm's firing mechanism in a completely neutralized state until such time the firearm is actually intended for use, at which time the firearm may be caused to functions quickly and easily.

U.S. Pat. Nos. 875,469(Tambour); 905,020(Tambour); 2,945,316(Mulno); 4,067,132(Smith); 4,135,320(Smith); 4,154,014(Smith); and 4,730,537(Matzagg et al) disclose firearm locking devices which all operate to disable the normal functioning of a firing mechanism by either blocking or otherwise locking up the movement of various internal parts of a firearm. U.S. Pat. No. 4,682,435(Heltzel) discloses a remotely-controlled electronic device which operates to physically disconnect and then re-connect the firearm's mechanical linkage between the trigger and the hammer. U.S. Pat. No. 4,672,763(Cunningham) discloses an emergency device which physically disconnects the hammer spring of an armed and ready firearm via the movement of a non-removable stop member, after which the user must take off the grip covers and manually reassemble the internal hammer spring assembly in order to make the firearm functional once again.

SUMMARY OF THE INVENTION

It is an object of the invention to provide a simple and inexpensive means for completely disabling a firearm until needed, at which time the firing assembly can be made to function easily and quickly The invention may be employed in newly manufactured firearms or may be retrofitted to an existing firearm.

The invention may be employed in a firearm of the type having a body with an interior space, a hammer supported by the body for movement and a trigger for actuating the hammer. A strut member has one end pivotally connected to the hammer. A capsule is provided having first and second ends and a spring means located therein Opening means is formed at said first end of said capsule whereby said spring means may be compressed by applying force to said spring means by way of said opening means. Said capsule is adapted to be supported by said body in a given position relative to said second end of said strut member whereby the other end of the said strut member will apply force to said spring means, by way of said opening means to allow sufficient spring compression to occur such that said hammer will fire the firearm when actuated by said trigger. Means is provided for releasably holding said capsule in said given position for firing purposes and for allowing said capsule to be released from said given position for releasing spring compression to disable the firearm.

In one embodiment, said capsule is completely removable from the firearm.

In another embodiment, a releasable keeper is provided which is movable into an opening for engaging the other end of said capsule for moving said capsule to said given position and for holding said capsule in said given position for firing purposes. The keeper may be released to allow said capsule to be moved away from said given position for disabling purposes.

BRIEF DESCRIPTION OF THE DRAWINGS

FIG. 16 is a side view of the capsule device of FIGS. 12–15.

FIG. 17 is a view of the capsule device of FIG. 16 from the grip end.

FIG. 18 is a full cross-sectional view of the capsule device of FIG. 16 containing the pre-loaded firing spring. This view also shows a ball bearing retention mechanism.

FIG. 19 is a view of the capsule device of FIG. 16 from the end adapted to receive the hammer strut

DESCRIPTION OF THE EMBODIMENTS OF FIGS. 1-5

Figure 1:
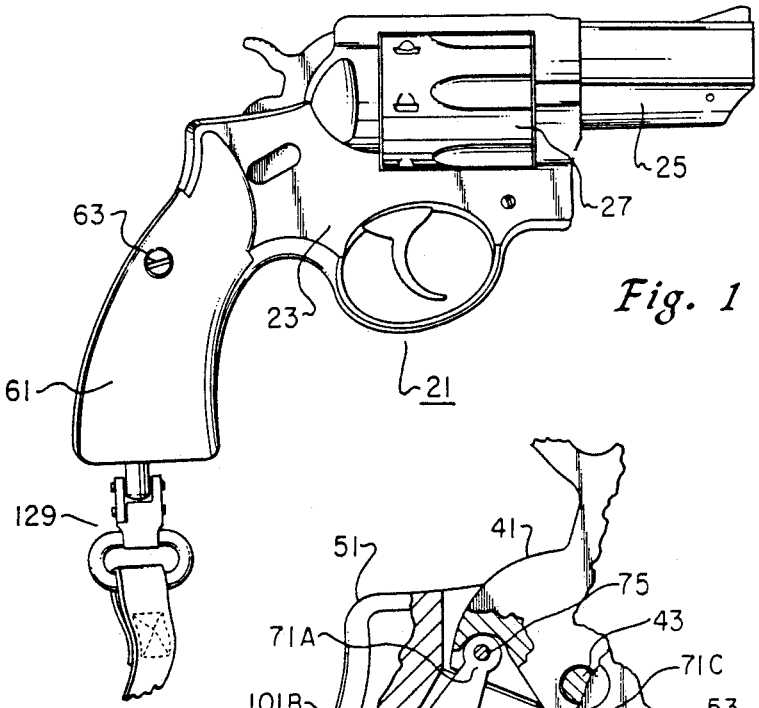
FIG. 1 is a side view of a revolver.
Figure 2:
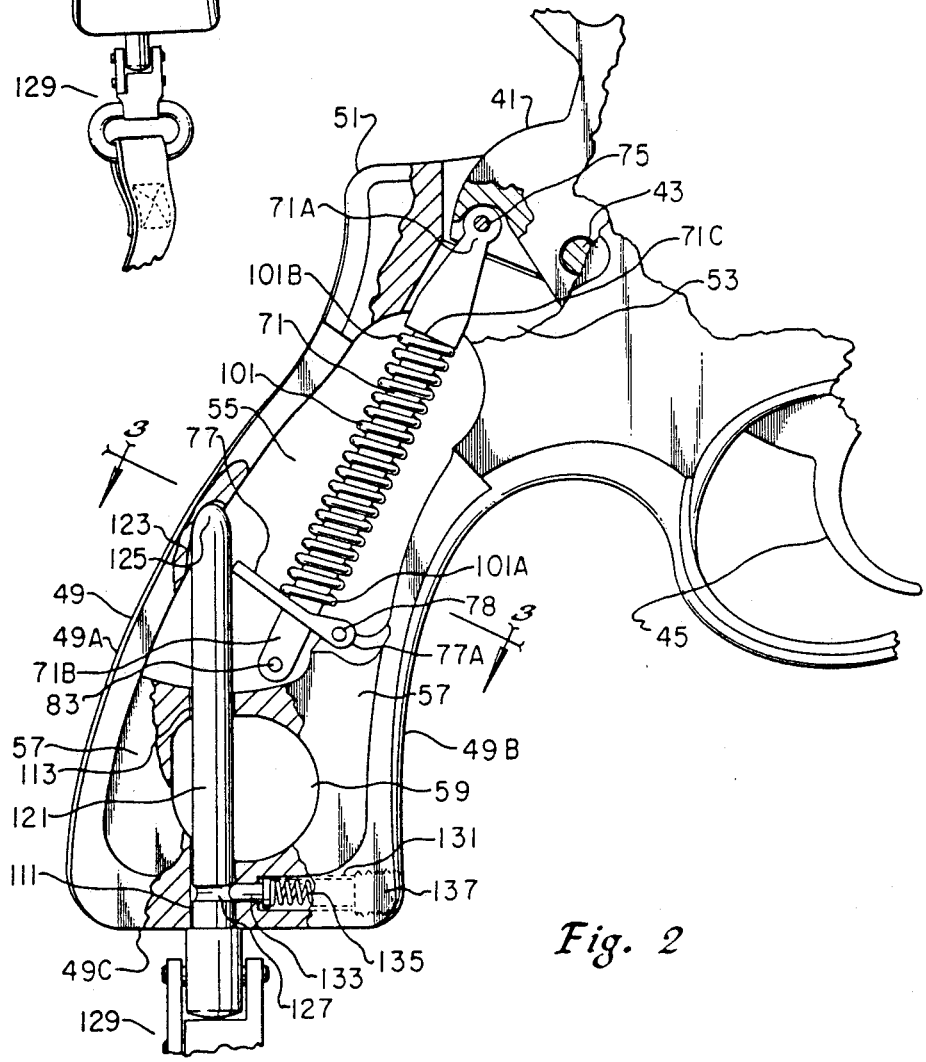
FIG. 2 is a partial cross-sectional view of a revolver illustrating an apparatus activated to place the revolver in an enabled state.
Figure 4:
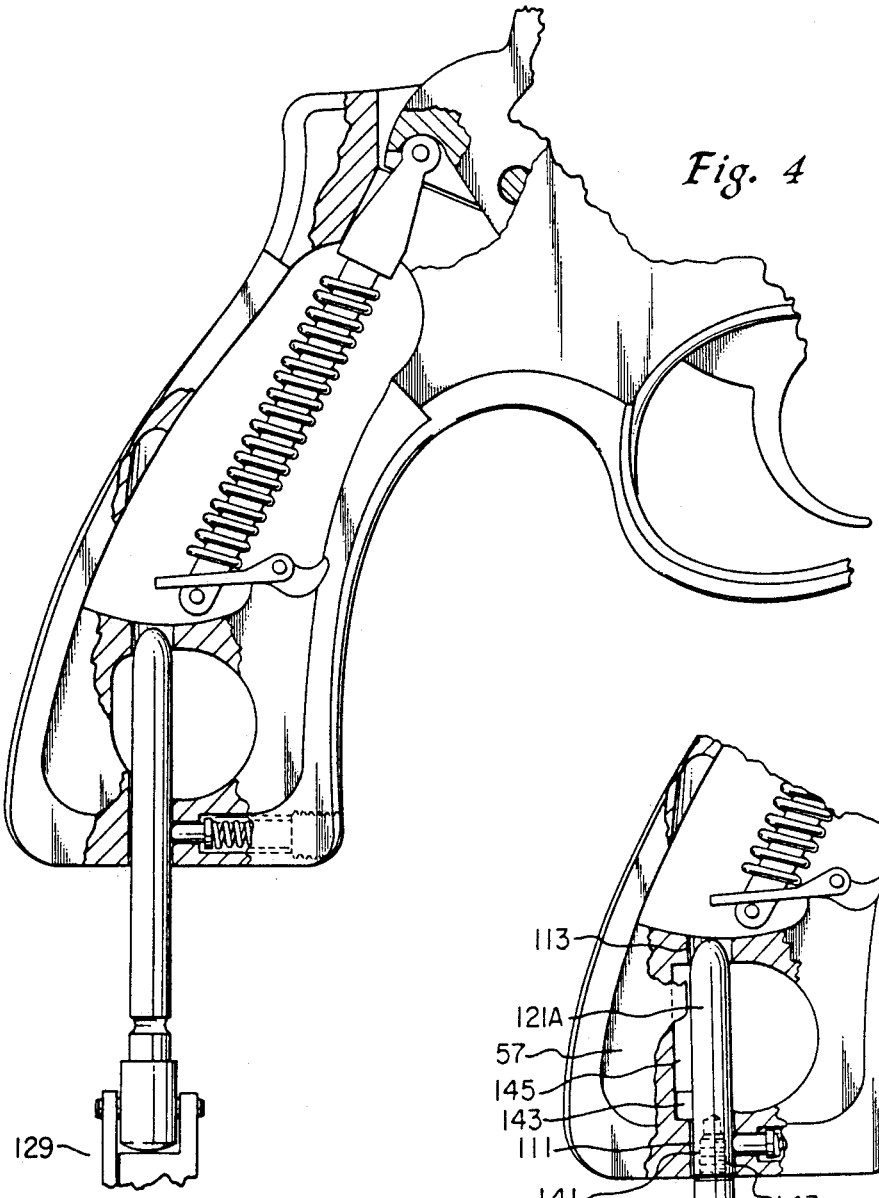
FIG. 4 is a partial cross-section of the revolver of FIG. 2 illustrating the apparatus deactivated to place the revolver in a disabled state.

Referring now to FIGS. 1-4, there is illustrated a . revolver 21. The revolver 21 comprises a body 23 which supports a barrel 25 and a cylinder 27. A hammer 41 is pivotally coupled to the body by a pin 43. In FIGS. 1, 2, and 4, the hammer 41 is shown in its rest position The body 21 also supports a trigger 45 for actuating the hammer 41 for firing the revolver. When the trigger 45 is pulled, the hammer 41 is pivoted backward and then released to fire the revolver 21.

The body 21 includes a handle 49. The body 21 comprises wall structure 51 which is hollow such that a hollow or interior space is provided at 53 which extends downward into the handle 49 at 55. The handle 49 has lower transverse cross support structure 57 extending between edges 49A and 49B. Lower hollow interior space is provided at 59. Two covers 61 are removably secured to opposite sides of the handle 49 by a bolt 63 and nut, not shown. The bolt 63 is inserted through an aperture formed through one of the covers 61, through the interior space 55, through an aperture formed through the other cover 61 and is screwed into the nut on the other side of the other covers 61.

A strut member 71 has one end 71A pivotally connected to the hammer 41 by a pin 75. A bridge member 77 has one end 77A pivotally connected by a pin 78 to the interior structure 57 of the handle 49 near its edge 49B. The bridge member 77 extends into the interior space 55 of the handle 49 and has an aperture 79 formed therethrough for freely and slideably receiving the other end 71B of the strut member 71. A pin 83 extends through the lower end 71B of the strut member and outward from opposite sides thereof below the bridge member 77 for preventing passage of the strut member 71 back through the aperture 79 of the bridge member 77. The bridge member 77 may be pivoted between a first or enabling position, as shown in FIG. 2, and a second or released position, as shown in FIG. 4

A helical coiled spring 101 is located around the strut member 71 and has one end 101A adapted to engage the top side of the bridge member 77 and an opposite end 101B adapted to engage a shoulder 71C formed on the strut member 71 near its end 71A when the assembly is in the engaged position, as shown in FIG. 2. The inside diameter of the coil 101 is sufficient to allow it to freely slide along the length of the strut member 71 between the bridge member 77 and the shoulder 71C when the bridge member 77 is in its released position, as shown in FIG. 4. When the bridge member 77 is moved to its enabling position, as shown in FIG. 2, the spring 101 is compressed and contained securely between the bridge member 77 and the strut shoulder 71C applying sufficient pressure or tension against the hammer 41 thereby placing the revolver in an enabled state. In this state, when the trigger 45 is pulled, the hammer 41 is caused to move forward by the force created by the compressed spring for firing the revolver. When the bridge member 77 is moved to its released position, as shown in FIG. 4, the pressure on the spring 101 is released thereby placing the revolver in a disengaged state. In this state, when the trigger 45 is pulled, the spring 101 cannot cause the hammer to pivot forward whereby the revolver cannot be fired because no spring compression can occur due to the relative positions of the parts The pivotal connection of the strut member 71 to the hammer 41 by the pin 75 and the size of the aperture 79 formed in the bridge member 77 allow the strut member to pivot freely about the pin 75 so as to allow the strut member to adjust to the constantly changing positions and relative angles created as the hammer 41 is pivoted forward and/or rearward during operation The strut member 77 remains connected to the hammer 41 at all times whether in operation or in a "neutral" position.

Aligned apertures 111 and 113 are formed through the lower edge 49C of the handle and through the transverse support structure 57 for slideably receiving a keeper member 121. The aperture 111 and 113 also are in alignment with the free end of the bridge member 77 when in its released position, as shown in FIG. 4, and with another aperture 123 formed in the inner edge 49A of the handle. The keeper member 121 has a rounded end 125 and an annular groove 127 formed around its other end which also has a grip member 129 connected thereto. The keeper member 121 can be moved from a position out of engagement With the bridge member 77, as shown in FIG. 4, to a position whereby it engages the lower side of the bridge member 77 and moves it upward to an enabling position, as shown in FIG. 2. When the keeper member 121 and bridge member 77 are in their enabling positions, as shown in FIG. 2, the spring 101 is contained sufficiently to allow sufficient spring compression to occur such that the hammer will fire the revolver when the trigger 45 is pulled.

When the keeper 121 is in its enabling position, its groove 127 is in alignment with an aperture 131 formed through the lower edge 49B of the handle 49 and a detent member 133 biased by a spring 135 releasably engages the groove 127 and holds the keeper 121 in this position. The spring 135 is held in place by a set screw 137 screwed into the outer threaded end of the aperture 131. When the user desires to place the revolver in a disengaged state, he can readily pull the keeper member 121 out of the handle 49 which releases the compression on the spring whereby the revolver can not fire when the trigger is pulled. The user can place the keeper 121 in his pocket or in a designated safe place. In the "neutral" position, the strut member 71 remains pivotally connected to the hammer 41 and the bridge member 77 remains pivotally connected to the inside structure of the handle with the spring 101 surrounding the strut member 71. The strut member 77 is prevented by the pin 83 from being removed from the bridge member 77. Thus, the revolver can be readily placed in the enabled state without the necessity of removing the covers 61 from the handle by simply inserting the keeper member 121 into the handle through the apertures 111 and 113 and moving it against the bridge member until the end 125 of the keeper 121 is located in the aperture 123 and the detent 121 engages the groove 127 thereby placing the bridge member 77 in its enabling position to allow compression of the spring 101 to occur enabling the revolver to be fired by pulling the trigger 45.

In the alternative, the bridge member 77 may be constructed of a leaf/spring design that is formed in an open "L" shape One end of the leaf/spring will be connected to the interior structure 57, either by a spot weld or slipped into a slot or pocket in the frame support structure 57. The bend in the leaf/spring will be functionally located similar to the pivot pin 59. The other end of the leaf/ spring will extend into the interior space 55 and have an aperture for freely receiving the end of the strut member 71 as described in connection with the bridge member 77. Constructed of the desired tensile strength, this configuration allows the one-piece bridge member itself to work like a "spring" board when the keeper 121 is inserted into the apertures 111 and 113 and moved inward to move the bridge member to its enabling position to allow sufficient compression of the spring 101 to occur for firing the firearm when the trigger 45 is pulled. When the keeper 121 is removed from the revolver, the leaf/spring will move to its released position similar to that shown of the bridge member in FIG. 4. This modification eliminates the requirement for a separate hinge or pin 78

Figure 5:
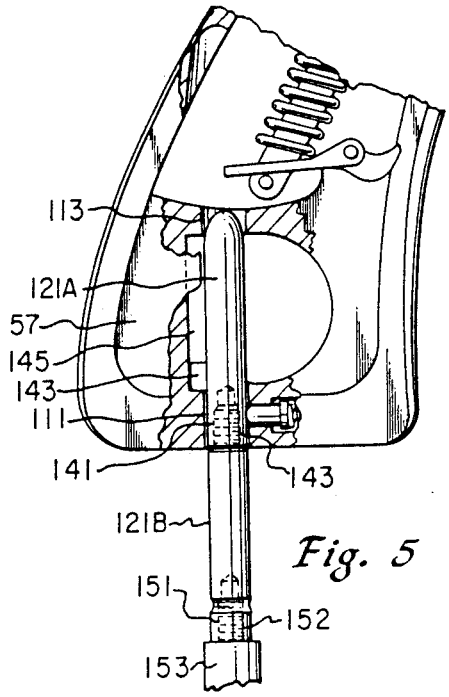
FIG. 5 illustrates a modification of a keeper.
Figure 3:
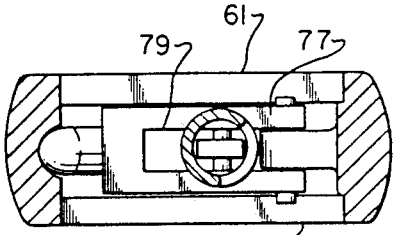
FIG. 3 is a cross-section of FIG. 2 taken along the lines 3—3 thereof.

Referring to FIG. 5, the keeper 121 is modified to be formed into two parts, an interior portion 121A and a lower portion 121B which can be coupled to and uncoupled from the interior portion 121A. Interior portion 121A has a threaded aperture 141 formed in its lower end and the lower portion 121B has a threaded end 143 adapted to be screwed into the aperture 141 and to be removed therefrom. A key 143 is attached to one side of the interior member 121A which is slideable in a slot 145 formed in the interior structure 57. The key 143 and slot 145 maintain the interior member 121A in the same angular position but allow it to move toward and away from the bridge member 77. The combined keeper 121A and 121B act in the same manner as the keeper 121 to engage the brige member 77 and move it upward to compress the spring as described previously. The keeper 121A and 121B can be moved to a position out of engagement with the bridge member 77 to place the firearm in a disabled position In this position, the lower removable portion 121B can be uncoupled from the interior portion 121A and placed in the user's pocket, etc. The interior portion 121A however will remain in the interior of the firearm and is prevented from passing through the aperture 113 by the key 143.

The lower portion 121B of the keeper may also have a threaded aperture 151 formed in its lower end for receiving the threaded end 152 of a grip member 153 which may be unscrewed from the lower portion 121B when the keeper 121A and 121B is in its enabling position to minimize protuberance of the keeper from the firearm.

In the preferred embodiment, the detent 127 will make an audible "click" when it enters the groove 127 as the keeper 121, or 121A and 121B is moved into the compressing position, thus allowing the user to hear a "clicking" noise indicating that the firing system is engaged and functional.

Although the invention was described as being employed in a revolver, it is to be understood that it could be employed in many types of pistols, rifles, shotguns, etc. In the preferred embodiment, the keeper 121, or 121A and 121B is inserted through the hand grip butt, however, it also could be inserted through the top side of certain types of firearms or even through the butt plate of a rifle stock.

The overall length of the keeper 121, or 121A and 121B depends upon the distance from the external point of insertion up to the point where the keeper is totally inserted plus the length of the external portion of the keeper which remains protruding from the firearm after the keeper has been fully inserted. The length of the keeper would allow for the thickness of any overlay that the keeper may also pass through, i.e. pistol grips, rifle stocks, etc As an alternative, the overall length of the keeper 121, or 121A and 121B, may be of a length that does not protrude from the firearm even when fully inserted to its enabling position but rather remains flush with the normal external body covers or remains somewhat recessed within an aperture in the housing cover. This design results in the keeper 121 not interfering with the user's normal grip. While using the firearm, the cosmetic profile and appearance of the firearm is not altered while still allowing for quick access to the keeper so the firearm may be easily disabled.

DESCRIPTION OF THE PREFERRED EMBODIMENTS

Referring now to FIGS. 6–11 of the drawings, there is illustrated a handgun 201 employing one embodiment of the invention. The handgun 201 comprises a body 202 which supports a barrel 204. The body 202 also includes a handle 203(handgrip) which contains a hollow interior space beginning at 205 which extends downward into the handle 203 and additionally at 206. Openings 205 and 206 form an obtuse angle relative to each other. The handgun 201 is shown utilizing interior support structure 208A and 208B secured to the handle edges 203A and 203B, respectively. Openings 205 and 206 are formed between the support structure 208A and 208B. The opening 205 allows a hammer strut 218 to pass freely therethrough and make contact with a capsule device 207 which is also loosely contained within the opening 205. Due to the angle formed by the two openings 205 and 206, the capsule 207 cannot pass from opening 205 into opening 206, but its lower end 207B is exposed to the opening 206.

The handgun 201 also utilizes two handgrip covers 211 which are removably secured to opposite sides of the handle 203 by a bolt 212 and a nut, not shown. The bolt 212 is inserted through an aperture formed through one of the covers 211, through aperture 213 formed through structure 208A and is screwed onto the nut in an aperture formed through the second cover 211, not shown. The capsule 207 may be located within the opening 205 when one of the covers 211 is removed.

Certain appropriate sections of the handgun 201 or handgrip covers 211 may be made of transparent materials, such as clear plastic or polymers. The user of the firearm may easily view the internal workings of the firearm and thus determine whether the firearm's firing assembly is operative without physically handling the firearm, thus providing better firearm safety.

The body 201 also supports a trigger 214 for actuating the hammer 215, which is pivotally coupled to the body 202 by a pin 216. In normal operation, when the trigger 214 is pulled, the hammer 215 is pivoted rearward and then released to pivot forward with sufficient force to fire the handgun 201. As used herein, the "hammer" is that part which is commonly caused to move by a firing spring to cause firing to occur, whether by directly striking an explosive cartridge, or by acting against a firing pin which is thereby caused to strike a cartridge, or by its movement allows compressed air or gas to enter a chamber holding a projectile and thus expel (fire) the projectile, such as in BB and pellet guns.

A hammer strut 218 has an end 218B pivotally connected to the hammer 215 by a pin 215B.

Figure 10:
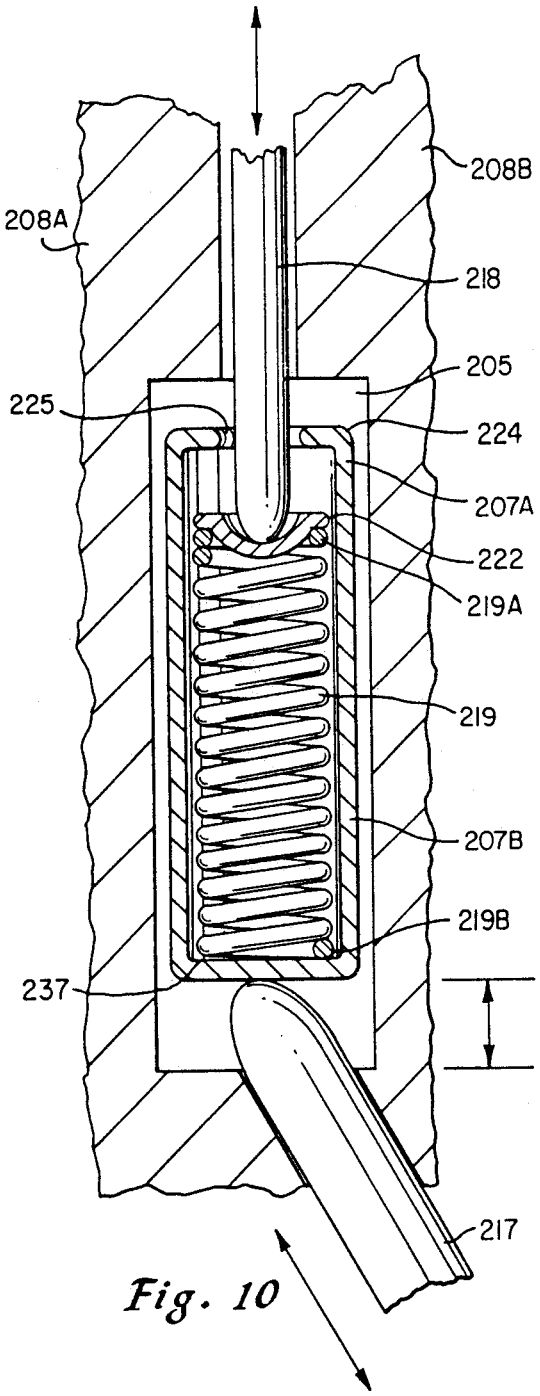
FIG. 10 is a cross-sectional view of a portion of the firearm illustrating the interaction of the keeper means, the capsule device containing the firing spring and the hammer strut of the embodiment of FIGS. 6–8 while the firing mechanism is enabled.
Figure 11:
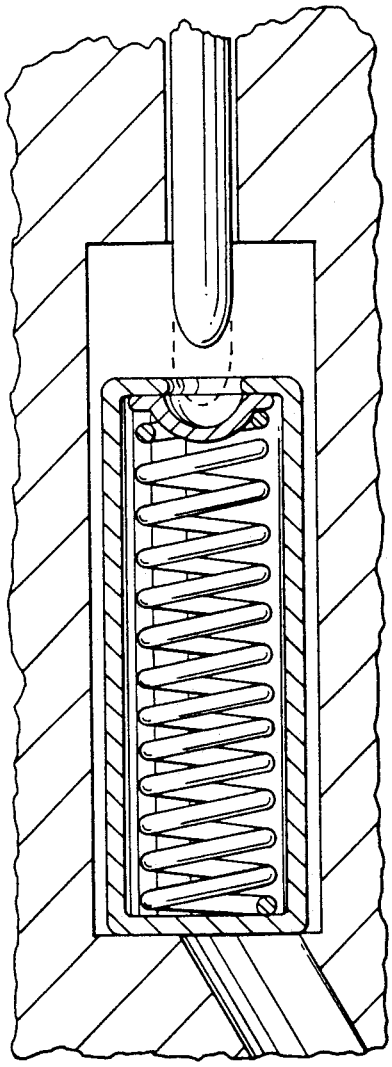
FIG. 11 is a cross-sectional view of a portion of the firearm illustrating the non-interaction of the hammer strut and capsule device firing spring of the embodiment of FIGS. 6–8, resulting from the withdrawal of the keeper means, thus disabling the firing mechanism.

At the heart of the invention is the capsule device 207 as illustrated in detail in FIGS. 10 and 11. The capsule device 207 is a cylindrical structure formed so as to contain a firing spring 219 and a hammer strut seat 222 within its interior. The size and shape of the capsule device 207 is designed to be able to allow it to be used in different firearms. The hammer strut seat 222 resembles a cupped washed or similar device which is formed so as to create a "seat" for the hammer strut end 218A to rest in and allow interaction between the hammer strut 218 and the firing spring 219 when the capsule device 207 is inserted into the firearm aperture 205. The hammer strut seat 222 is maintained in place between the firing spring end 219A and the inside of the lip 224 formed in the end 207A of the capsule device 207 by the force exerted by the pre-loaded firing spring 219. The second end 207B of the capsule device is formed as illustrated to engage the keeper means 217 when fully inserted so as to retain the capsule device 207 securely in place during operation of the firearm. The hammer strut end 218A extends through the opening 225 formed through the end 207A of the capsule 207 to engage the seat 222.

The second end of the keeper means 217 is provided with a grasping member 235 which may be used to manipulate the keeper means 217 in and out of the firearm 201.

An aperture 231 is formed through the external edge 203C of the handle 203 in alignment with the opening 206 for slideably receiving the keeper means 217.

Figure 7:
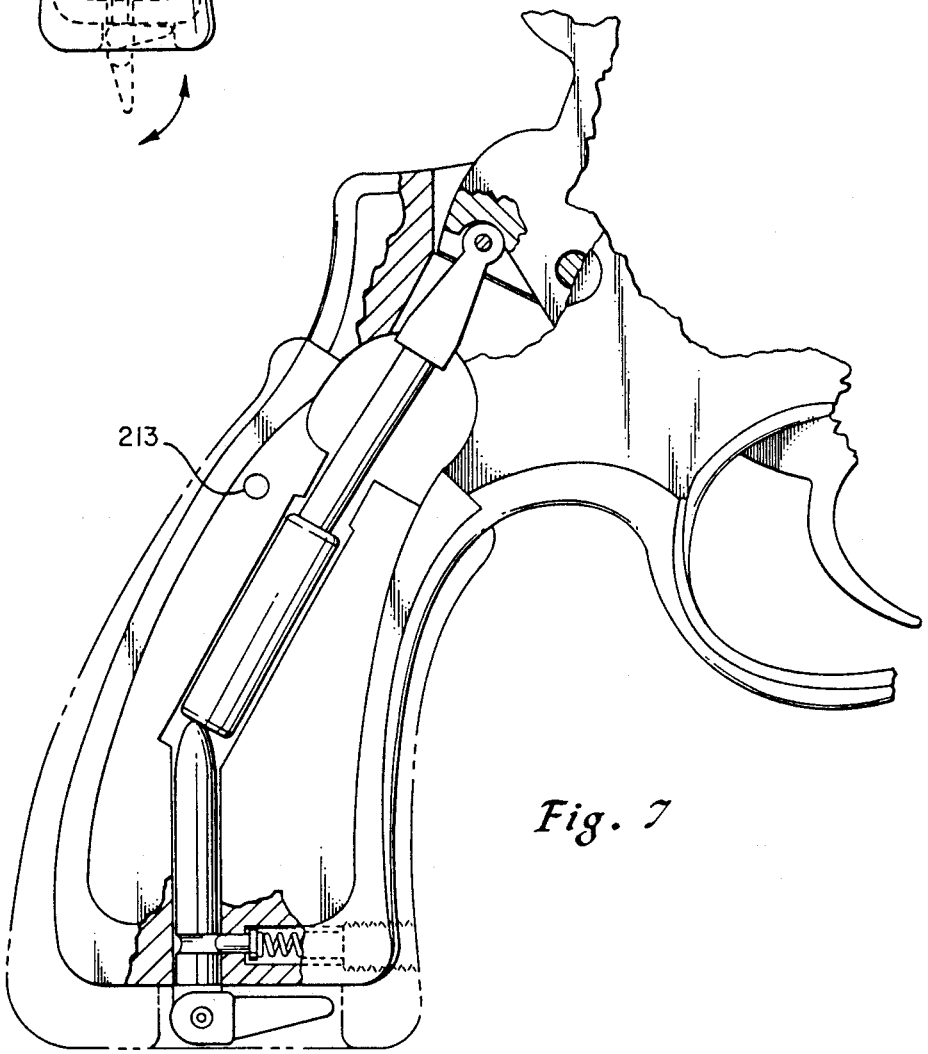
FIG. 7 is a partial cross-sectional view of the handgun of FIG. 6 illustrating the keeper means and capsule device of FIG. 6 securely seated in place and the firing assembly fully functional.
Figures 8, 9:
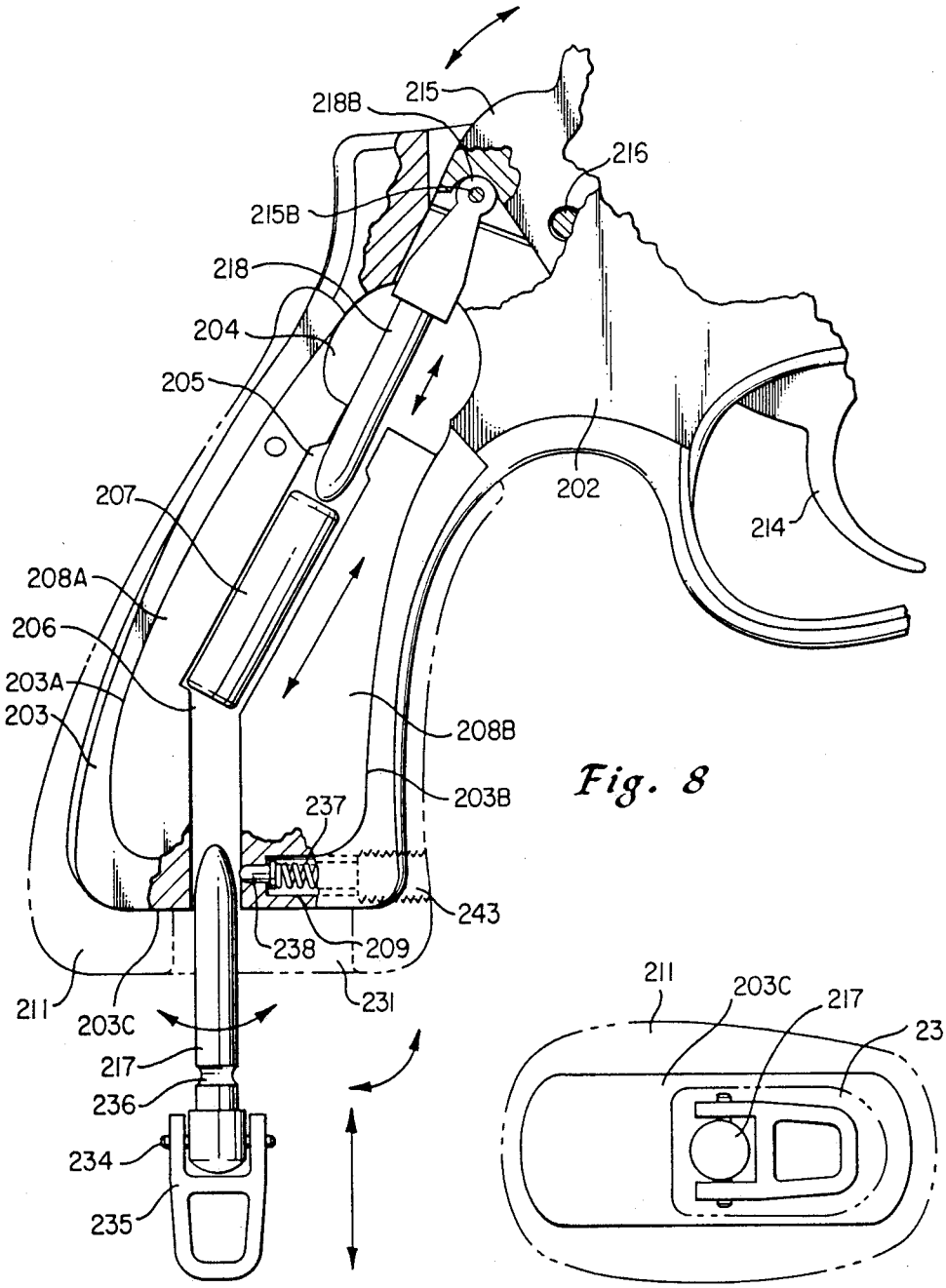
FIG. 8 is a partial cross-sectional view of the handgun of FIG. 6 illustrating the keeper means withdrawn, the capsule device located away from the hammer strut and the firing assembly completely disabled.
FIG. 9 is a bottom view of the firearm butt plate of the embodiment of FIGS. 6–8 illustrating the relative location of the keeper when fully inserted with the grip member folded over.

The capsule device 207 may be moved via the keeper device 217 from a position out of engagement with the hammer strut end 218A as shown in FIGS. 8 and 11 to a position whereby it engages the free end 218A of the hammer strut 218 as shown in FIGS. 7 and 10. When the user desires to disable the firearm, he may readily pull the keeper means 217 out of the handle 203 and thereby release the tension of the firing spring 219 action against the hammer 215 via the hammer strut 218, thus leaving the firearm completely unable to fire when the trigger 214 is pulled. Once removed, the user may carry the keeper means 217 in a pocket or store it in a designated safe place away from the firearm, thereby effectively preventing the unauthorized and accidental misuse of the firearm.

The firing spring 219, also commonly known as a "mainspring", a "striker spring" or a "firing pin spring" is illustrated as a helical coil spring 219 which is securely contained within the capsule device 207. One end 219A of the firing spring 219 is adapted to engage the hammer strut seat 222. The opposite end 219B of the firing spring 219 is adapted to engage the interior base of the capsule device 207 at 237. Although the preferred embodiment illustrates a helical-type coil spring 219, other types of common torsion or compression springs may be used. The firing spring 219 remains contained within the capsule device 207 at all times. In the preferred embodiment, the firing spring 219 is securely contained within the capsule 207 under tension created by the pre-loading or pre-compression of the firing spring to the desired tension. The particular amount of pre-loaded spring 219 tension may vary from firearm to firearm, but it is of sufficient potential energy already created in the spring 219 so that when the capsule device 207 is fully engaged against the hammer strut 218, it will already contain that amount of potential energy needed to cause the hammer 215 to move with sufficient force to cause normal firing to occur. Additional spring compression will also occur when the firearm is "cocked" as shown in FIG. 10.

As an alternative, the same design of capsule device 207 and firing spring 219 containment therein may be used with the exception that the firing spring 219 is contained loosely therein with little or no pre-loaded tension In this design, firing spring 219 compression may only occur when the capsule device 207 comes in contact with the free end 218A of the hammer strut 218, at which time the cocking of the firearm hammer 215 causes the free end 218A of the hammer strut 218 to engage the hammer strut seat 222 and force it inward into the interior of the capsule device 207, thus causing compression of the firing spring 219 to occur as illustrated in FIG. 10.

When the capsule device 207 is securely retained in its enabling position as shown in FIG. 7, the hammer strut seat 222 and the free end 218A of the hammer strut 218 make a positive contact with each other. When in this position, as the hammer 215 is moved to the "cocked" position, the hammer strut 218 is also caused to move toward the capsule device 207 which thereby causes additional compression of the firing spring 219 to occur. When released via the trigger 214, the hammer 215 is caused to move forward by the energy created by the compressed firing spring 219. When the keeper device 217 is removed from the firearm, the firing spring 219 tension acting against the hammer strut 218 is thereby completely relaxed. In this state, the firearm cannot be fired by pulling the trigger 214 because no firing spring 219 compression is available to cause the hammer 215 to pivot forward with sufficient force to cause normal firing to occur. Thus, the firearm may be readily placed in either the enabled or disabled state by the user without the removal of the covers 211 from the handle 203 and also without any disassembly or reassembly of any of the firearm's other component parts.

Figure 6:
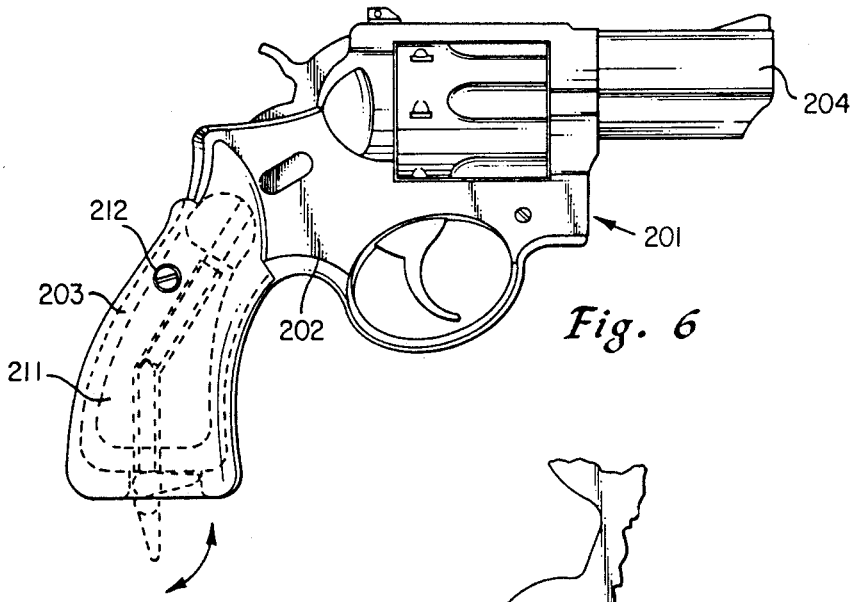
FIG. 6 is a side view of a handgun illustrating one embodiment of the invention.

The keeper means 217 may be easily and completely removed from the firearm by the user whenever desired by grasping the grip member 235 and pulling the keeper 217 out of the handle 203 of the firearm. The grip member 235 is pivotally connected to the keeper 217 by a pin 234 so that the grip member 235 may be rotated 360 degrees and also may be folded over to fit flush with or recessed within the covers 211 when fully inserted as shown in FIGS. 6 and 7, or extended to aid in the removal of the keeper means 217 as shown in FIG. 8.

The keeper means 217 may be constructed of virtually an unlimited combination of randomly-sequenced patterns and shapes, much the same as an ordinary key. The internal portion of the firearm's structure will then have a corresponding pattern of hindrance points that must be negotiated by the proper keeper means design in order to engage the capsule device 207. This feature will ensure that only the correct keeper means can be properly inserted to enable any given firearm.

Although illustrated in its simplest forms, the capsule device 207 and the keeper means 217 may be formed into virtually an unlimited number of shapes and sizes, such as a curved shape or even in a spiraling twist shape. The devices can also be constructed of a variety of materials, such as metal or plastics. The devices can also be of a rigid construction or formed of flexible materials so as to accommodate some curvature or twisting designed to occur during insertion or removal.

As an alternative, when the keeper means 217 is fully inserted, an annular groove 236 formed in and around the lower end of the keeper 217 is in alignment with an aperture 238 formed through the lower edge 203C of the handle 203. A detent mechanism 238 biased by a spring 237 is located in the aperture 238 such that the detent member 238 releasably engages the annular groove 236 to hold tension against the keeper means 217 while inserted. The amount of tension acting on the keeper means 217 is enough to hold it in place while inserted, but the tension can also be easily overcome by the force exerted by the user to pull the keeper means 217 from the firearm. The detent spring 237 is held in place by a set screw 243 screwed into the outer threaded end of the aperture 290. In the preferred embodiment, the detent mechanism 238 will make an audible noise when it enters the groove 236 as the keeper means 217 is inserted into the enabling position, thus allowing the user to hear a "clicking" noise indicating that the firing assembly is engaged and functional.

As an alternative, the type of detent mechanism 238 used may be one with a longer stem than that illustrated that can move from a first position whereby it is in contact with the inserted keeper means 217 to a second position whereby it moves into and completely blocks the void space created in the aperture 205 when the keeper means 217 has been completely removed from the firearm. This type of detent mechanism is then moveable back to its first position to allow insertion of the keeper means 217 only by using a particular type of tool or key-like device which will be inserted through the aperture 290 to grasp the head of the detent mechanism and pull the detent 238 outward and back to its first position. This arrangement will provide a positive lock-out feature to deter an attempted circumvention of the inherent safety features of the invention by the attempted insertion of a foreign object other than the correct keeper means, such as a nail, pencil, or wire, etc.

Also as an alternative, the keeper means 217 may incorporate a combination of two or more annular grooves and detent mechanisms, for purposes of additional bracing and support, or as a variation of the automatic lockout feature as described above, or to form a check-stop or "standby" position for when the keeper means 217 has been only partially inserted.

Also as an alternative means to hold the keeper means 217 in place, the base of the keeper 217 and the aperture 238 may be formed into a retention mechanism using ball bearings and a spring-loaded release plunger. By pulling out on the grip member 235, the user will cause the spring tension holding the ball bearings to relax and the ball bearings to move inward, thus allowing the easy insertion or removal of the keeper means 217.

Also as an alternative means to hold the keeper means 217 in place, the base of the keeper 217 and the aperture 205 may be formed into a bayonet plug type of connection as is commonly found in the use of automobile taillight bulbs. The keeper means 217 will have protruding stubs extending outward at a point near its base and in alignment with the corresponding grooves formed on the interior of the aperture 205, so that the user will simply push in, twist and then release the keeper means 217 to insert it and to have it held securely in place. Removal of the keeper means 217 will be by a reversal of the process just described.

Also as an alternative means to hold the keeper means 217 in place, the base of the keeper 217 and the aperture 205 can be formed into a common threaded screw-in type of connection. Although this configuration would provide one of the most secure methods of holding the keeper means 217 in place while inserted, it would also take the user a few seconds longer to disable and/or enable the firearm.

Regardless of the retention method used for the keeper means 217, after it has been removed from the firearm, a common plug can be inserted into the aperture 205 which would prevent foreign objects, dust or dirt from entering the firearm.

In the preferred embodiment, the keeper means 217 is inserted through the bottom of the handle 203 However, the location for the point of insertion of the keeper 217 can also be through the top or the side of certain types of firearms, or even through the butt plate of a rifle or shotgun stock. This feature is especially intended for the retrofitting of the invention into existing rifles and shotguns. Either or both of the hammer strut 218 and or the capsule device 207 can be several inches long if needed, but the removable keeper means 217 can be standardized in size that is easily handled or carried by the user, much like an ordinary key.

In the preferred embodiment, the keeper means 217 will be of a length that does not protrude from the firearm when fully inserted to the enabling position, but either remains flush with the normal external body covers 211 or remains somewhat recessed within the aperture 231 in the body covers 211. This design results in the keeper not interfering with the user's normal grip of the firearm. Also, the normal cosmetic profile and appearance of the firearm is not altered while still allowing for quick access to the capsule device 207. Some firearm designs may also incorporate a removable cover plate to cover the aperture Referring now to FIGS. 12–21, there will be described another embodiment of the invention. A handgun 301 is shown which comprises a body 302 which supports a barrel 304. The body 302 also includes a handle 303(handgrip) which contains a hollow interior space 304 which extends downward into the handle 303 to space 305. The handgun 301 is shown utilizing optional support structure 308(cross-brace) extending between edges 303A and 303B. The structure has an opening 308A to allow a hammer strut 318 to pass freely therethrough.

The handgun 301 also utilizes two handgrip covers 311 which are removably secured to opposite sides of the handle 303 by a bolt 312 and a nut, not shown. The bolt 312 is inserted through an aperture formed through one of the covers 311, through the interior space of the handle and is screwed onto the nut in an aperture formed through the second cover 311.

Certain appropriate sections of the hand gun 311 or handgrip covers 311 may be made of transparent materials, such as clear plastic or polymers as described previously.

The body 301 also supports a trigger 314 for actuating the hammer 315, which is pivotally coupled to the body 301 by a pin 316. A hammer strut 318 has an end 318B which is pivotally connected to the hammer 315 by a pin 315A. In normal operation, when the trigger 314 is pulled, the hammer 315 is pivoted rearward and then released to pivot forward with sufficient force to fire the handgun 301. As used herein, the "hammer" is that part which is commonly caused to move by a firing spring to cause firing to occur, whether by directly striking an explosive cartridge, or by acting against a firing pin which is thereby caused to strike a cartridge, or by its movement allows compressed air or gas to enter a chamber holding a projectile and thus expel(fire) the projectile, such as in BB and pellet guns.

The heart of the invention of this embodiment is a removable capsule device 307 as illustrated in detail in FIGS. 16 through 21. The capsule device 307 is a cylindrical structure formed so as to contain a firing spring 319 and a hammer strut seat 322 within its interior. The size and shape of the capsule device 307 is designed to allow it to be used in different firearms. The hammer strut seat 322 resembles a cupped washer or similar device which is formed so as to create a "seat" for the hammer strut and 318A to rest in and allow interaction between the hammer strut 318 and the firing spring 319 when the capsule device 307 is inserted into the firearm aperture. The hammer strut seat 322 is maintained in place between the firing spring end 319A and the inside of the lip 324 formed in the end 307A of the capsule device 307 by the force exerted by the pre-loaded firing spring 319. The end 318A of the hammer strut 318 extends through an opening 325 formed through the end 307A of the capsule 307 to engage the seat 322. The capsule 307 is insertable within the opening 325 of the firearm and is held in place within the opening 325 by a suitable retention mechanism during operation of the firearm. In the opening 325, the end 307A of the capsule is located next to the end 318A of the hammer strut 318. A grasping member 335 is secured to the other end of the capsule 307 for use in manipulating the capsule 307 in and out of the firearm 301.

An aperture 331 is formed through the external edge 303C of the handle 303 in alignment with the opening 305 for slideably receiving the capsule 307.

Figure 14:
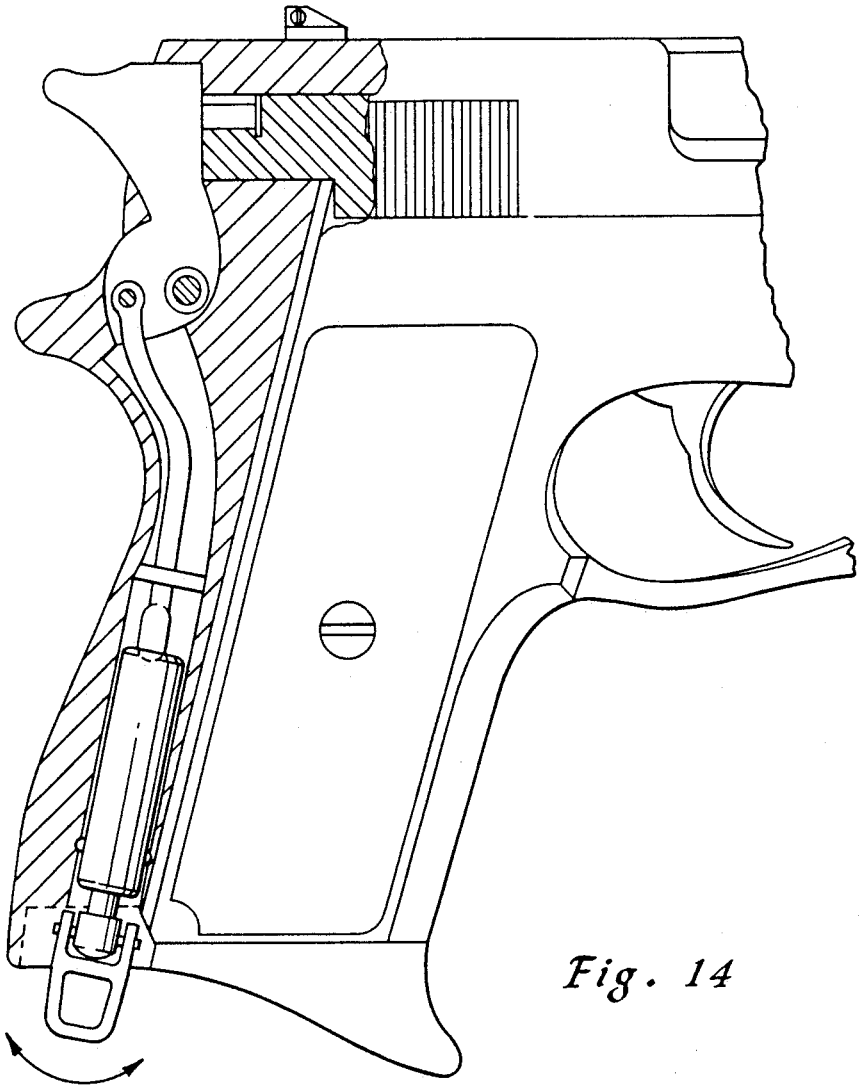
FIG. 14 is a partial cross-sectional view of a handgun of FIG. 12 illustrating the capsule device securely seated in place and the firing assembly fully functional.

The capsule device 307 may be inserted and moved from a position out of engagement with the hammer strut end 318A as shown in FIG. 14. When the user desires to place the firearm in the disabled state, he may readily pull the capsule device 307 out of the handle 303 and thereby release the tension of the firing spring 319 acting against the hammer 315 leaving the firearm unable to fire when the trigger 314 is pulled. Once removed, the user may carry the capsule device 307 in a pocket or store it in a designated safe place away from the firearm, thereby effectively preventing the unauthorized and accidental misuse of the firearm.

Figure 21:
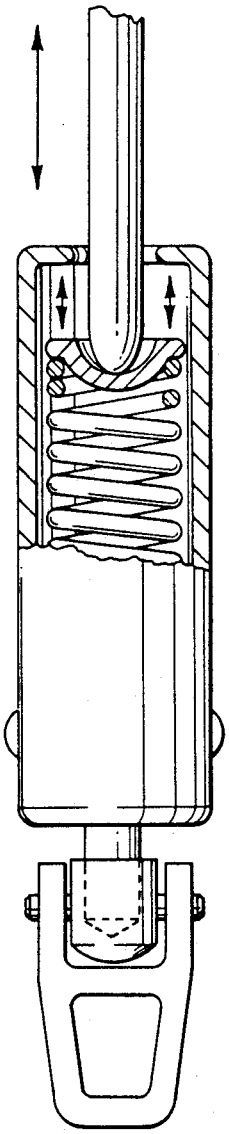
FIG. 21 is a partial cross-sectional view of the capsule device of FIG. 16 showing its interaction with the hammer strut while the firing assembly is operated.

The firing spring 319, also commonly known as a "mainspring", a "striker spring" or a "firing pin spring" is illustrated as a helical coil spring 319 which is securely contained within the removable capsule device 307. One end 319A of the firing spring 319 is adapted to engage the hammer strut seat 322. The opposite end 319B of the firing spring 319 is adapted to engage the interior base of the capsule device 307 at 337. Although the preferred embodiment illustrates a helical-type coil spring 319, other types of common torsion or compression springs may be used. The firing spring 319 remains contained within the capsule device 307 at all times. In the preferred embodiment, the firing spring 319 is securely contained within the capsule 307 under tension created by the pre-loading or precompression of the firing spring to the desired tension. The particular amount of pre-loaded spring tension may vary from firearm to firearm, but it is of sufficient potential energy already created in the spring 319 so that when the capsule device 307 is fully inserted into a firearm, it will already contain that amount of energy needed to cause the hammer 315 to move with sufficient force to cause normal firing to occur. Additional spring compression will also occur when the firearm is "cocked" as shown in FIG. 21.

As an alternative, the same design of capsule device 307 and firing spring 319 containment therein may be used with the exception that the firing spring 319 is contained loosely therein with little or no pre-loaded tension. In this design, firing spring 319 compression may only occur when the capsule device 307 is inserted into the firearm and comes in contact with the free end 318A of the hammer strut 318, at which time the continued insertion of the capsule device 307 to its fully inserted position causes the free end 318A of the hammer strut 318 to engage the hammer strut seat 322 and force it inward into the interior of the capsule device 307, thus causing compression of the firing spring 319 to occur as illustrated in FIG. 21.

When the capsule device 307 is inserted and securely retained in its enabling position as shown in FIG. 14, the hammer strut seat 322 and the free end 318A of the hammer strut 318 make a positive contact with each other. When in this position, as the hammer 315 is moved to the "cocked" position the hammer strut 318 is also caused to move toward the capsule device 307 which thereby causes additional compression of the firing spring 319 to occur. When released via the trigger 314, the hammer 315 is caused to move forward by the energy created by the compressed firing spring 319. When the capsule device 307 is removed from the firearm, the firing spring 319 is also thereby completely removed from the firearm. In this state, the firearm cannot be fired by pulling the trigger 314 because no firing spring 319 compression is available to cause the hammer 315 to pivot forward with sufficient force to cause normal firing to occur. Thus, the firearm may be readily placed in either the enabled or disabled state by the user without the removal of the covers 311 from the handle 303 and also without any disassembly or reassemble of any of the firearm's other component parts.

Figure 13:
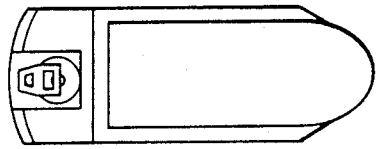
FIG. 13 is a bottom view of the firearm butt plate of the handgun of FIG. 12.
Figure 12:
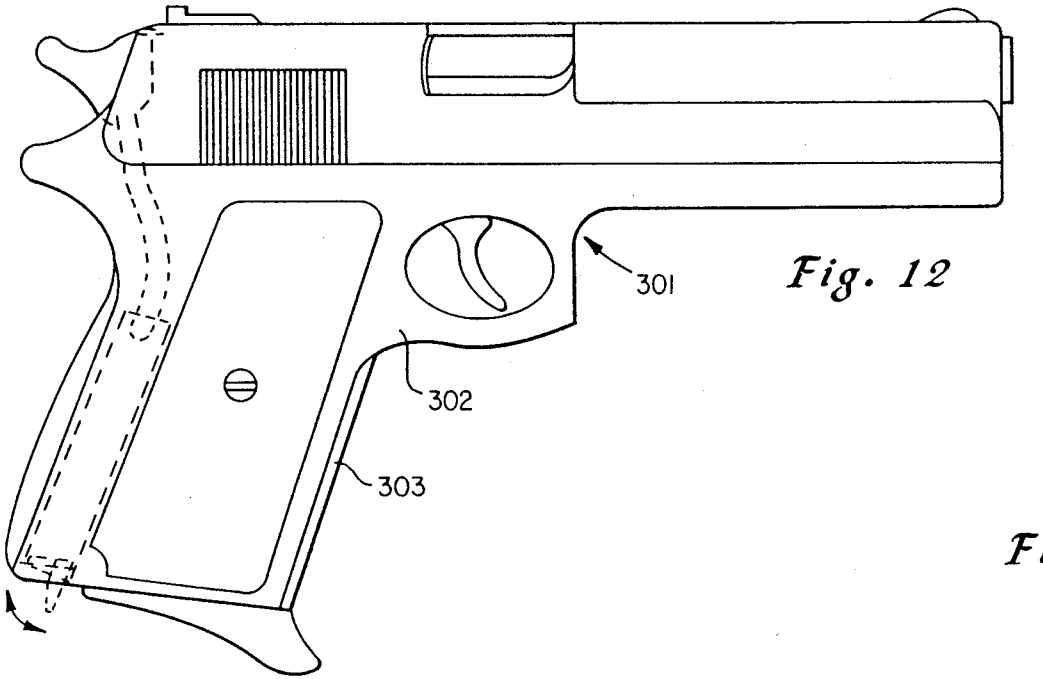
FIG. 12 is a side view of a handgun employing another embodiment of the invention.
Figure 15:
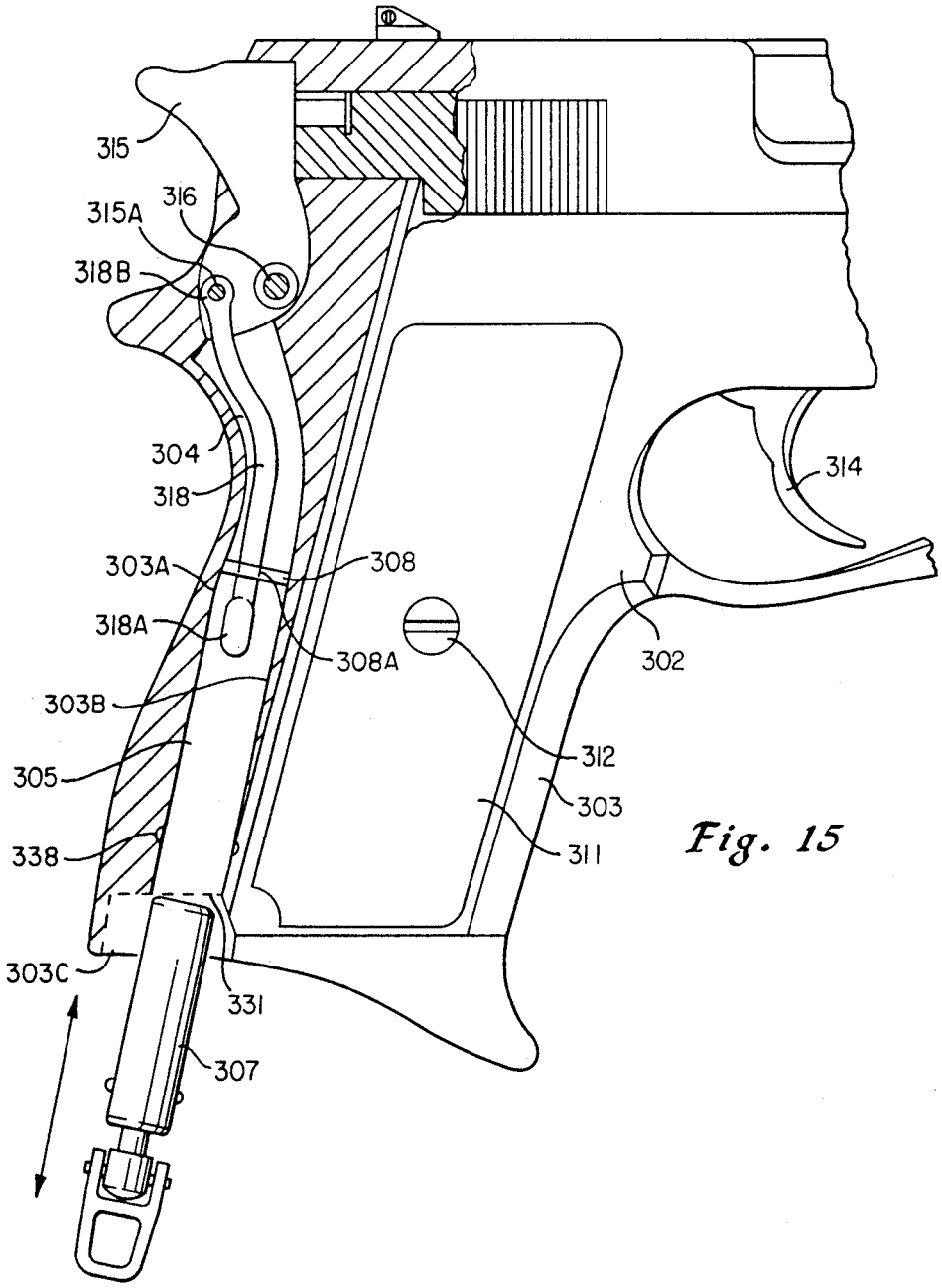
FIG. 15 is a partial cross-sectional view of the handgun of FIG. 12 illustrating the capsule device withdrawn and the firing assembly completely disabled.
Figure 20:
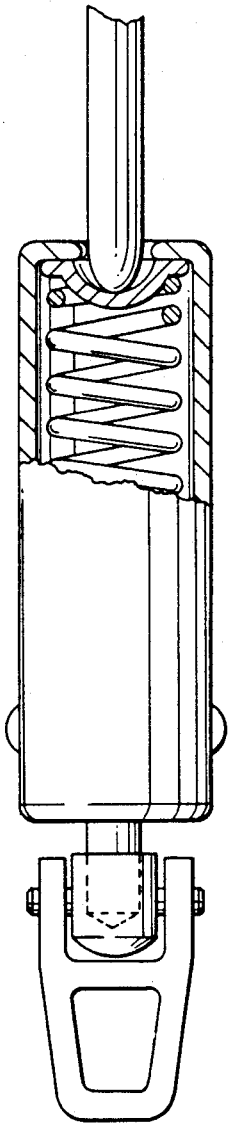
FIG. 20 is a partial cross-sectional view of the capsule device of FIG. 16 showing its interaction with the hammer strut while the hammer is "at rest".

The capsule device 307 may be easily and completely removed from the firearm by the user whenever desired by grasping the grip member 335 and pulling the capsule 307 out of the handle 303 of the firearm. The grip member 335 is pivotally connected to the capsule device 307 by a pin 334 so that the grip member 335 may be rotated 360 degrees and also may be folded over to fit flush with or recessed within the covers 311 when fully inserted as shown in FIGS. 12 and 13, or extended to aid in the removal of the capsule device 307 as shown in FIGS. 14 and 15.

The capsule device 307 may be constructed of virtually an unlimited combination of randomly-sequenced patterns and shapes, much the same as an ordinary key. The internal portion of the firearm's structure will then have a corresponding pattern of hindrance points that must be negotiated by the proper capsule device 307 design in order to engage the hammer strut end 318A. This feature will ensure that only the correct capsule device 307 can be properly inserted to enable any given firearm.

Although illustrated in its simplest forms, the capsule device 307 may also be formed into virtually an unlimited number of shapes and sizes, such as a curved shape or even in a spiraling twist shape. The capsule device 307 can also be constructed of a variety of materials, such as metal or plastics. The capsule device 307 can also be of a rigid construction or formed of flexible materials so as to accommodate some curvature or twisting designed to occur during insertion or removal.

As an alternative, an annular groove may be formed around the lower end of the capsule 307 in a manner similar to the groove 236 formed around the lower end of the keeper 217 of FIG. 8 and an aperture and spring biased detent similar to that shown at 238, 236 and 237 of FIG. 8 may be employed for releasably holding the capsule in place in the opening 305. The detent mechanism may also comprise a long stem that will move from a first position whereby it is in contact with the inserted capsule device 307 to a second position where it moves into and completely blocks the void space created in the opening 305 when the capsule device 307 has been completely removed from the firearm This type of detent mechanism will then be moveable back to its first position to allow insertion of the capsule device 307 only by using a particular type of tool or key-like device which will be inserted through the detent aperture to grasp the head of the detent mechanism and pull the detent outward and back to its first position. This arrangement will provide a position lock-out feature to deter an attempted circumvention of the inherent safety features of the invention by the attempted insertion of a foreign object other than the correct capsule device 307, such as a nail, pencil, or wire, etc.

Also as an alternative, the capsule device 307 may incorporate a combination of two or more annular grooves and detent mechanisms for purposes of additional bracing and support, or as a variation of the automatic lockout feature as described above, or to form a check-stop or "standby" position for when the capsule device 307 has been only partially inserted.

Also as an alternative means to hold the capsule device 307 in place, the base of the capsule 307 and the aperture 338 as shown in FIG. 15 may be formed into a securing mechanism using ball bearings 344 and a spring-loaded release plunger 347, biased by a spring 349, as shown in FIG. 18. By pulling out on the grip member 335, the user will cause the spring tension holding the ball bearings 344 to relax and the balls to move inward, thus allowing the easy insertion or removal of the capsule device 307.

Also as an alternative means to hold the capsule device 307 in place, the base of the capsule 307 and the aperture 305 may be formed into a bayonet plug type of connection as is commonly found in the use of automobile taillight bulbs. The capsule device 307 will have protruding stubs extending outward at a point near its base and in alignment with the corresponding grooves formed on the interior of the aperture 305, so that the user will simply push in, twist and then release the capsule device 307 to insert it and to have it held securely in place. Removal of the capsule device 307 will be by a reversal of the process just described.

Also as an alternative means to hold the capsule device 307 in place, the base of the capsule 307 and the opening 305 can be formed into a common threaded screw-in type of connection. Although this configuration will provide one of the most secure methods of holding the capsule device 307 in place while inserted, it will also take the user a few seconds longer to disable and/or enable the firearm.

Regardless of the retention method used for the capsule device 307, after it has been removed from the firearm a common plug can be inserted into the aperture which will prevent foreign objects, dust or dirt from entering the firearm.

In the preferred embodiment, the capsule device 307 is inserted through the bottom of the handle 303. However, the location for the point of insertion of the capsule 307 can also be through the top or the side of certain types of firearms, or even through the butt plate of a rifle or shotgun stock. This feature is especially intended for the retrofitting of the invention into existing rifles and shotguns. The hammer strut 318 can be several inches long if needed, but the removable capsule device 307 can be standardized in size that is easily handled or carried on the user, much like an ordinary key.

In the preferred embodiment, the capsule device 307 will be of a length that does not protrude from the firearm when fully inserted to the enabling position, but either remains flush with the normal external body covers 311 or remains somewhat recessed within an aperture in the body covers. This design results in the capsule device 307 not interfering with the user's normal grip of the firearm. Also, the normal cosmetic profile and appearance of the firearm is not altered while still allowing for quick access to the capsule device 307. Some firearm designs may also incorporate a removable cover plate to cover the aperture.

Although the invention described and illustrated in firearms in FIGS. 6–21 utilize only one firing spring, the invention can be used in firearms which utilize more than one firing spring and more than one hammer. Although not illustrated, the invention can include such variations as two or more capsule devices working independently of each of the other inside the same firearm.

I claim:

1. An apparatus for preventing unauthorized firing of a firearm, comprising:

a body having wall structure and an interior space, a hammer supported for movement by said body, a trigger for actuating said hammer, a strut member having first and second ends located in the interior space of said body, said first end of said strut member being pivotally connected to said hammer, a capsule having first and second ends and a spring means located therein, opening means formed at said first end of said capsule whereby said spring means may be compressed by applying force to said spring means by way of said opening means, said capsule being removably locatable in a given position relative to said second end of said strut member whereby said second end of said strut member will apply force to said spring means, by way of said opening means when moved by said hammer upon actuation of said trigger to allow sufficient spring compression to occur such that said hammer will fire the firearm when actuated by said trigger, and means for releasably holding said capsule in said given position for firing purposes and for releasing said capsule from said given position for releasing spring compression to disable the firearm.

2. The apparatus of claim 1, wherein:

said capsule is completely removable from said firearm.

3. The apparatus of claim 1, wherein:

said wall structure of said body has an opening for receiving said capsule for allowing said capsule to be moved to said given position and to be removed from the firearm, said means for releasably holding said capsule in said given position, releasably holds said capsule in said given position in said opening.

4. The apparatus of claim 1, wherein:

said wall structure of said body has an opening, said means for releasably holding said capsule in said given position comprises a keeper means moveable into said opening for engaging said second end of said capsule and moving said capsule to said given position.

5. The apparatus of claim 1, wherein:

said spring means has first and second ends located near said first and second ends of said capsule respectively, said second end of said strut member is located to move said first end of said spring means towards said second end of said spring means to apply said force to said spring means when moved by said hammer upon actuation of said trigger.

6. The apparatus of claim 1, wherein:

said means for releasably holding said capsule in said given position for firing purposes engages said second end of said capsule when said capsule is held in said given position.

7. The apparatus of claim 6, wherein:

said means for releasably holding said capsule in said given position for firing purposes engages said second end of said capsule when said capsule is held in said given position.

8. The apparatus of claim 7, wherein:

said spring means comprises a helically wound spring means having a central opening, seat means which engages said first end of said spring means and prevents entry of said second end of said strut member into said central opening beyond said seat means, said second end of said strut member engages said seat means to apply said force to said spring means when moved by said hammer upon actuation of said trigger.

9. The apparatus of claim 1, wherein:

said capsule comprises side wall means for laterally holding said spring means in place in said capsule, said wall structure of said body comprises an opening formed by side wall structure for receiving said capsule, said side wall structure maintains the lateral position of said side wall means of said capsule, when said capsule is in said given position, sufficient to allow said second end of strut member to apply said force to said spring means when moved by said hammer upon actuation of said trigger.

10. The apparatus of claim 9, wherein:

said spring means has first and second ends located near said first and second ends of said capsule respectively, said second end of said strut member is located to move said first end of said spring means towards said second end of said spring means to apply said force to said spring means when moved by said hammer upon actuation of said trigger.

11. The apparatus of claim 9, wherein:

said means for releasably holding said capsule in said given position for firing purposes engages said second end of said capsule when said capsule is held in said given position.

12. The apparatus of claim 11, wherein:

said spring means comprises a helically wound spring means having a central opening, seat means which engages said first end of said spring means and prevents entry of said second end of said strut member into said central opening beyond said seat means, said second end of said strut member engages said seat means to apply said force to said spring means when moved by said hammer upon actuation of said trigger.

13. The apparatus of claim 3, wherein:

said springs means has first and second ends located near said first and second ends of said capsule respectively, said second end of said strut member is located to move said first end of said spring means towards said second end of said spring means to apply said force to said spring means when moved by said hammer upon actuation of said trigger.

14. The apparatus of claim 3, wherein:

said means for releasable holding said capsule in said given position for firing purposes engages said second end of said capsule when said capsule is held in said given position.

15. The apparatus of claim 13, wherein:

said means for releasable holding said capsule in said given position for firing purposes engages said second end of said capsule when said capsule is held in said given position.

16. The apparatus of claim 15, wherein:

said spring means comprises a helically wound spring means having a central opening, seat means which engages said first end of said spring means and prevents entry of said second end of said strut member into said central opening beyond said seat means, said second end of said strut member engages said seat means to apply said force to said spring means when moved by said hammer upon actuation of said trigger.

17. The apparatus of claim 3, wherein:

said capsule comprises side wall means for laterally holding said spring means in place in said capsule, said wall structure of said body comprises an opening formed by side wall structure for receiving said capsule, said side wall structure maintains the lateral position of said side wall means of said capsule, when said capsule is in said given position, sufficient to allow said second end of said strut member to apply said force to said spring means when moved by said hammer upon actuation of said trigger.

18. The apparatus of claim 17, wherein:

said springs means has first and second ends located near said first and second ends of said capsule respectively, said second end of said strut member is located to move said first end of said spring means towards said second end of said spring means to apply said force to said spring means when moved by said hammer upon actuation of said trigger.

19. The apparatus of claim 18, wherein:

said means for releasably holding said capsule in said given position for firing purposes engages said second end of said capsule when said capsule is held in said given position.

20. The apparatus of claim 19, wherein:

said capsule comprises side wall means for laterally holding said spring means in place in said capsule, said wall structure of said body comprises an opening formed by side wall structure for receiving said capsule, said side wall structure maintains the lateral position of said side wall means of said capsule, when said capsule is in said given position, sufficient to allow said second end of strut member to apply said force to said spring means when moved by said hammer upon actuation of said trigger.

21. The apparatus of claim 20, wherein:

said spring means comprises a helically wound spring means having a central opening, seat means which engages said first end of said spring means and prevents entry of said second end of said strut member into said central opening beyond said seat means, said second end of said strut member engages said seat means to apply said force to said spring means when moved by said hammer upon actuation of said trigger.

* * * * *